US010766674B2

(12) United States Patent
Agrawal et al.

(10) Patent No.: US 10,766,674 B2
(45) Date of Patent: Sep. 8, 2020

(54) CANNABIS STORAGE ASSEMBLY

(71) Applicant: Paper Tube LLC, Long Grove, IL (US)

(72) Inventors: Parag Agrawal, Buffalo Grove, IL (US); Vadim David Molo, Wheeling, IL (US)

(73) Assignee: Paper Tube, LLC, Long Grove, IL (US)

( * ) Notice: Subject to any disclaimer, the term of this patent is extended or adjusted under 35 U.S.C. 154(b) by 38 days.

(21) Appl. No.: 16/168,421

(22) Filed: Oct. 23, 2018

(65) Prior Publication Data

US 2020/0122905 A1 Apr. 23, 2020

(51) Int. Cl.

| | |
|---|---|
| ***B65D 50/04*** | (2006.01) |
| ***B65D 43/02*** | (2006.01) |
| ***B65D 85/00*** | (2006.01) |
| ***A61J 1/03*** | (2006.01) |

(52) U.S. Cl.

CPC ..... *B65D 50/041* (2013.01); *B65D 43/0229* (2013.01); *A61J 1/03* (2013.01); *B65D 85/00* (2013.01); *B65D 2543/00546* (2013.01)

(58) Field of Classification Search

CPC ..... B65D 50/041; B65D 43/0229; B65D 2543/00546; B65D 85/00; A61J 1/03

USPC ..... 220/787, 256.1, 259.5; 215/206, 355, 215/364

See application file for complete search history.

(56) References Cited

U.S. PATENT DOCUMENTS

| | | | | |
|---|---|---|---|---|
| 2,168,608 | A * | 8/1939 | O'Brien | B65D 47/065 222/498 |
| 3,587,896 | A | 6/1971 | Graff | |
| 3,896,958 | A | 7/1975 | Robbins et al. | |
| 3,998,354 | A * | 12/1976 | Song | B65D 39/04 220/269 |
| 4,121,727 | A | 10/1978 | Robbins et al. | |
| 4,231,486 | A * | 11/1980 | Bock | B65D 21/0219 220/266 |
| 4,238,033 | A | 12/1980 | Artzt | |
| 4,506,794 | A | 3/1985 | Wilson | |
| 4,512,487 | A * | 4/1985 | Augros | B65D 47/06 215/274 |
| 5,292,017 | A | 3/1994 | Reifers | |
| 5,727,704 | A * | 3/1998 | Glynn | B65D 50/04 215/221 |
| 6,758,358 | B1 | 7/2004 | Bloom | |
| 8,746,486 | B2 | 7/2014 | Del Solar et al. | |
| 2003/0141273 | A1 * | 7/2003 | Osti | B65D 23/00 215/364 |

* cited by examiner

*Primary Examiner* — James N Smalley

(74) *Attorney, Agent, or Firm* — Bhatia IP Advisors, LLC; Aman Bhatia

(57) ABSTRACT

A cannabis storage assembly includes a cap assembly comprised of a cap and a base, as well as a container upon which the cap assembly is mounted. Upon proper alignment of the cap into the base and further manipulation of the cap relative to the base once inserted, the user of the cannabis storage assembly can fully secure the container's contents.

19 Claims, 4 Drawing Sheets

CANNABIS STORAGE ASSEMBLY

This is a nonprovisional application for patent under 35 U.S.C. § 111(a).

TECHNICAL FIELD

The instant disclosure relates to cannabis storage containers.

BACKGROUND

Though current storage containers and assemblies recognize the need for secure containment, they currently only utilize a single means of access prevention. These available containers fall short in addressing concerns regarding the free movement of parts or features in addition to unencumbered access to contents despite the fact that these assemblies may indeed have some sort of security feature.

Cannabis, much like medications or other potentially harmful or toxic substances, requires secure containment, especially for those individuals who are not designated for its use. These individuals could be children, the elderly, or any person for whom the contained substance is not prescribed, designated, or legally permitted. As such, it is imperative that these individuals be protected from accidentally encountering or using these very substances through ensured prevention of access; particularly, cannabis. Accordingly, there is a need for a secure assembly that utilizes multiple mechanisms of access prevention.

BRIEF DESCRIPTION OF THE DRAWINGS

One or more preferred exemplary embodiments will hereinafter be described in conjunction with the appended drawings, wherein like designations denote like elements, and wherein.

DETAILED DESCRIPTION

The cannabis storage assembly of the instant disclosure solves these problems—a single means of deterrence and unencumbered access despite a security feature—by requiring the proper alignment of the cap and the base—a first mechanism of prevention. Upon proper alignment, when the cap is inserted into the base, the cannabis storage assembly enters a configuration in which the contents of the container are secured, though the assembly could at this point potentially be unsecured by its user. Furthermore, upon manipulation of the cap's orientation relative to the base, a second mechanism of prevention, the storage assembly enters another secure configuration, thusly completely preventing access to the container's contents.

Figure 1:
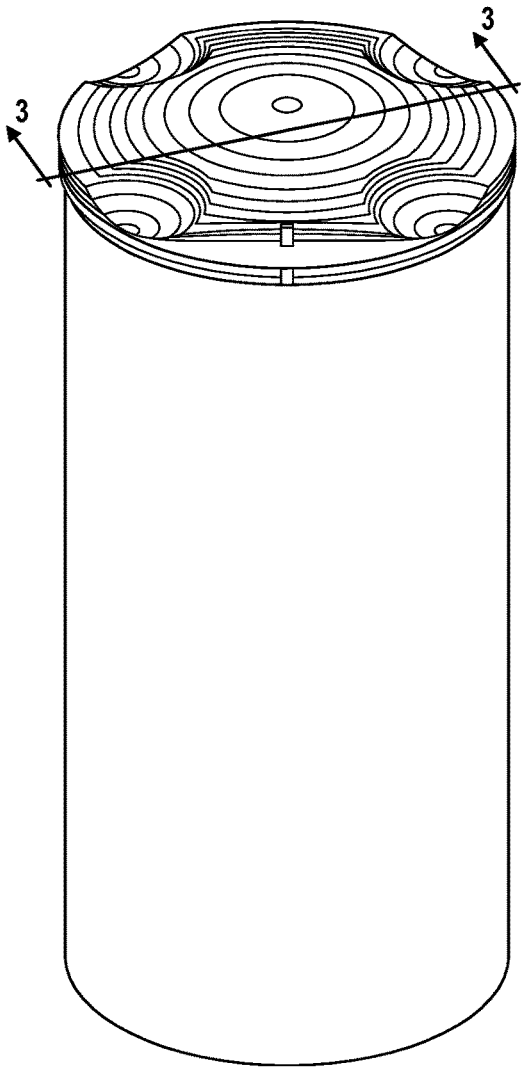
FIG. 1 is a top side perspective view of an exemplary embodiment of a cannabis storage assembly of the present disclosure.

Referring to the drawings, and in particular FIG. 1, an exemplary embodiment of a cannabis storage assembly 10, designed to be child-resistant, is shown according to the instant disclosure. Referring to FIG. 4B, the base 200 is inserted into the container 100, and the cap 300 is interested into a base 200.

Figure 2:
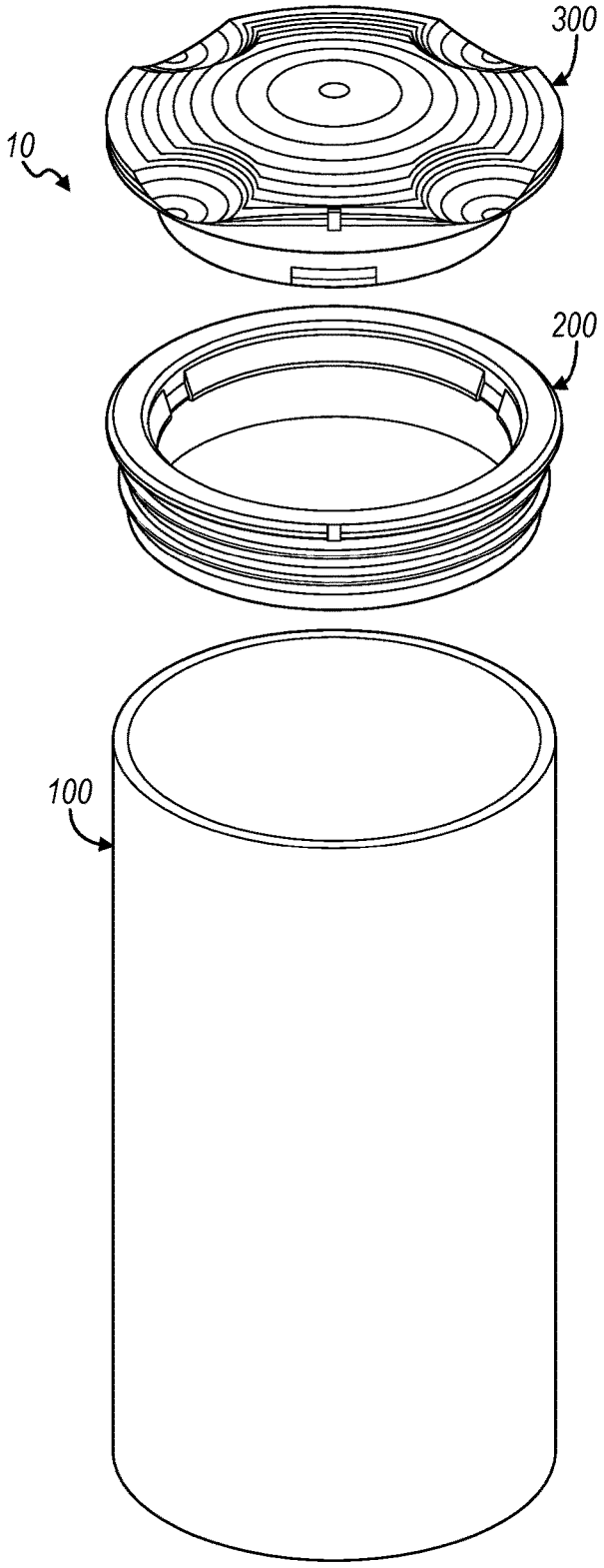
FIG. 2 is an exploded view of the cap, the base, and the container of the cannabis storage assembly of FIG. 1.
Figure 3:
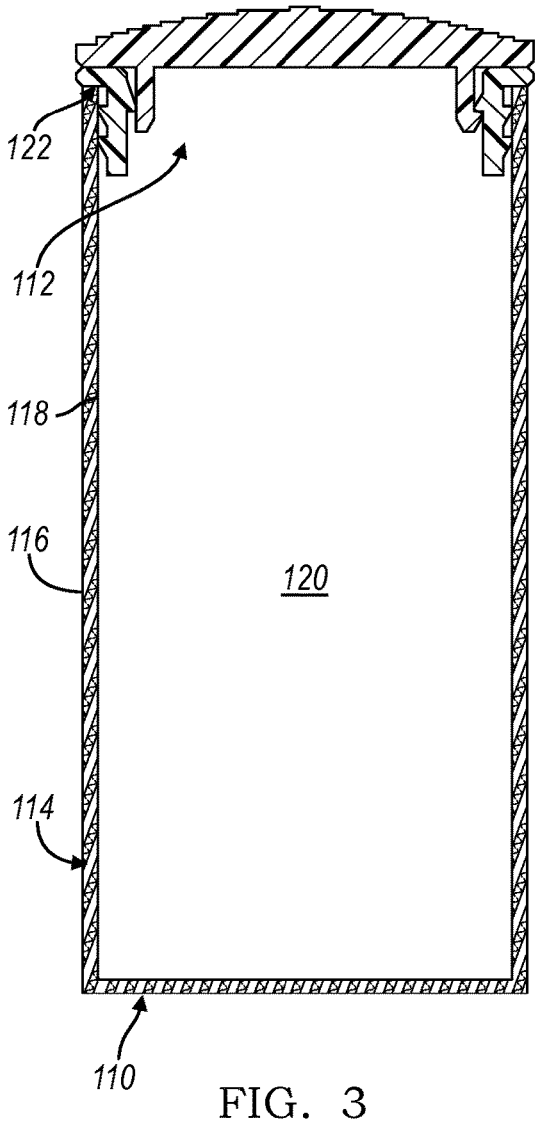
FIG. 3 is a cross-sectional view of the view of the cannabis storage assembly of FIG. 1.
Figure 5A:
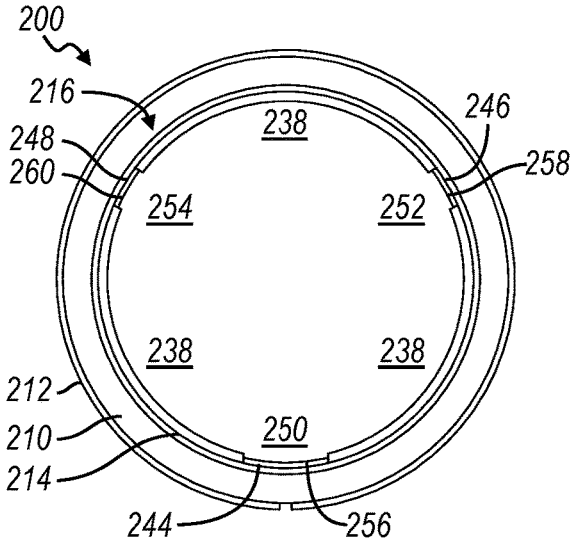
FIG. 5A is a top view of the base.
Figure 5B:
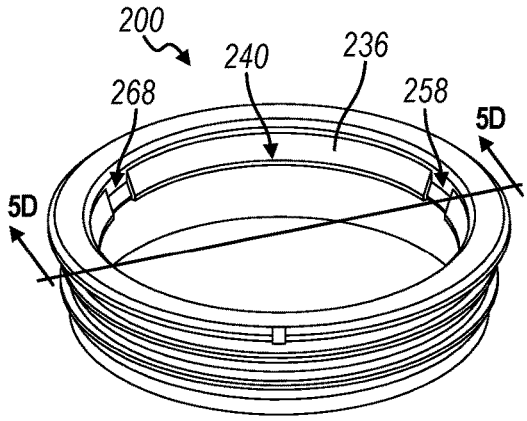
FIG. 5B is a top perspective view of the base.

Referring to FIG. 3, The container 100 has a closed end 110 and an open end 112. The container 100 has a first wall 114. The first wall 114 terminates at the open end 112 at a first edge 122. The first wall 114 has a first inner surface 116 which faces an interior volume 120, as well as a first outer surface 118 opposite the interior volume 120. The interior volume 120 of the container 100 allows the user of the assembly to place contents within it, or alternatively, is the area from which the assembly's user may retrieve contents. In the embodiment depicted in the figures, the first wall 114 extends perpendicularly away from the closed end 110. Referring to FIG. 2 and FIG. 5A, the base 200 is shown. The base 200 has a rim 210. The rim 210 has a first circumference 212 and a second circumference 214, where the second circumference 214 is located interior to the first circumference 212 relative to a common center. Referring to FIG. 5B and FIG. 5F, in the embodiment depicted, the rim 210 has a first upper surface 216 and a first under surface 218. Furthermore, in the embodiment shown, the differential between the first circumference 212 and the second circumference 214 creates an area between them. The rim 210 contains a second edge 220. In the embodiment depicted in the figures, the second edge 220 contains a first set of visual indicia 222. The first set of visual indicia 222 may take, for example, the form of words, arrows, lines, or other similar markings. The first set of visual indicia 222 works in concert with a second set of visual indicia 328, further herein disclosed, to allow the assembly's user to confirm whether the base 200 is in proper alignment with the cap 300, further herein disclosed, or conversely, whether the base 200 and the cap 300 are out of alignment. In the embodiment shown in the figures, the first set of visual indicia 222 take the form of at least one line.

Referring to FIG. 5F, the base 200 has a second wall 224. The second wall 224 has a second inner surface 226 and a second outer surface 228. In this embodiment, the second inner surface 226 is situated such that it is flush with the second circumference 214 of the rim 210. The second wall 224 has a third circumference 230 and a fourth circumference 232, where the fourth circumference 232 is located interior to the third circumference 230 relative to a common center. Additionally in the embodiment depicted in the figures, the second wall 224 extends perpendicularly away from the rim 210.

Referring to FIG. 5B and FIG. 5F the second wall 224 has a third edge 234. The second wall 224 contains a lip 236. Referring to FIG. 5A, the lip 236 has a first extent 238 that is at least a portion of the fourth circumference 232. Referring to FIG. 5D, in the embodiment depicted, the lip 236 is located on the second inner surface 226. Further referring to FIG. 5D and FIG. 5F, in the embodiment shown, the lip 236 has a second upper surface 240 and a second under surface 242, where the second under surface 242 of the lip 236 is oriented such that it is parallel to the first under surface 218 of the rim 210, and the second upper surface 240 is oriented such that it makes an acute angle with respect to the second inner surface 226 and creates a vertex with the the second under surface 242. The lip 236 serves as the means by which the base 200 and the cap 300 interact such that the assembly can be brought from a semi-secured configuration to a secured configuration, further herein disclosed, respectively, or from a secured configuration to a semi-secured configuration.

Referring to FIG. 5A, the lip 236 defines at least one notch. In the embodiment shown, the at least one notch is of a second extent 250. In this embodiment, the lip 236 defines a first notch 244, a second notch 246, and a third notch 248. The second notch 246 and the third notch 248 are of a third extent 252 and a fourth extent 254, respectively, where the second extent 250 and the third extent 252 are both different than the first extent 238. The at least one notch serves as the space into which the at least one prong, further herein disclosed, may be inserted upon manipulation of the cap 300 into the base 200 by the assembly's user.

Referring to FIG. 5B, FIG. 5D, and FIG. 5F, the at least one notch contains at least one ledge. The at least one ledge spans a fifth extent 262 that is at least a portion of the second extent 250 of the first notch 244. In the embodiment depicted in the figures, the assembly contains a first ledge 256, a second ledge 258, and a third ledge 260, where the second ledge 258 is of a sixth extent 264 and the third ledge 260 is of a seventh extent 266. In the embodiment depicted in the figures, the at least one ledge contains a third upper surface 268 and a third under surface 270. The third under surface 270 is oriented such that it is parallel to the first under surface 218. The third upper surface 268 is oriented such that it makes an acute angle with respect to the second inner surface 226 and creates a vertex with the third under surface 270. The interaction of the at least one prong and the at least one ledge provides the resistance required to be overcome by the assembly's user such that the at least one prong can be urged over the at least one ledge and thus brought into a semi-secured configuration. Conversely, the interaction between the at least one prong and the at least one ledge provides the resistance required to be overcome by the assembly's user such that the at least one prong can be urged over the at least one ledge in the opposite direction as previously stated such that assembly can be brought from a semi-secured configuration to an unsecured configuration, also further herein disclosed.

Figure 5C:
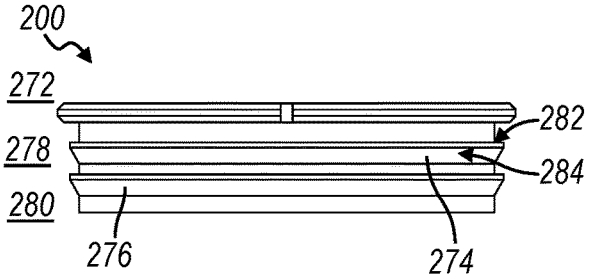
FIG. 5C is a side profile view of the base.
Figure 5D:
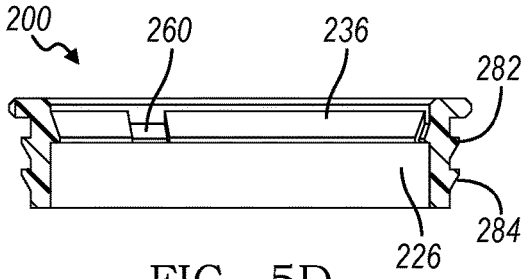
FIG. 5D is a cross-sectional view of the base.
Figure 5E:
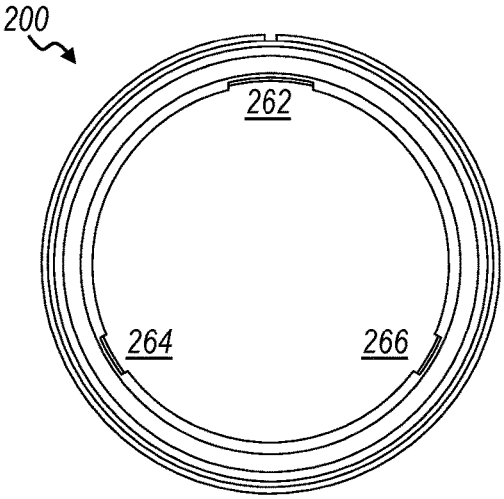
FIG. 5E is a bottom view of the base.
Figure 5F:
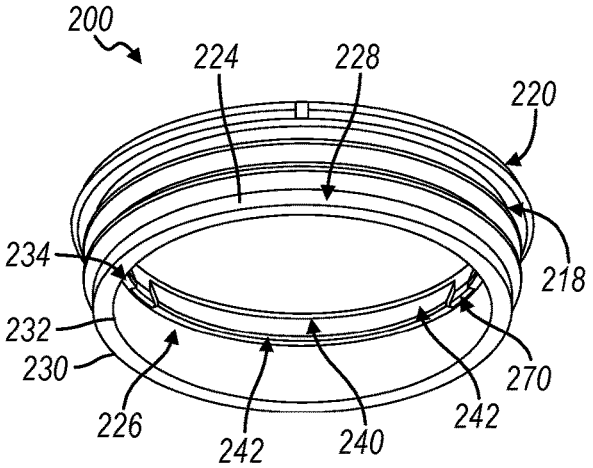
FIG. 5F is a bottom perspective view of the base.

Referring further to FIG. 5C, the base 200 contains at least one means of immobilization 272 upon interaction with the container 100. In the embodiment depicted in the figures, the base 200 contains as a means of immobilization 272 at least one rib. Particularly in the embodiment depicted, the base 200 contains a first rib 274 and a second rib 276, where the first rib 274 has an eighth extent 278 and the second rib 276 has a ninth extent 280, where the eighth extent 278 and the ninth extent 280 are at least a portion of the third circumference 230. Additionally in the embodiment shown in the figures, the at least one rib has a fourth upper surface 282 and fourth under surface 284, where the fourth upper surface 282 is oriented such that it is parallel to the first under surface 218, and the fourth under surface 284 is oriented such that it makes an acute angle with respect to the second outer surface 228 and creates a vertex with the fourth upper surface 282. The at least one rib provides the assembly the means of interaction between the base 200 with the first inner surface 116 such that the at least one rib prevents the rotational, ascending, descending, and lateral movement of the base 200 when inserted into the container 100.

Figure 6A:
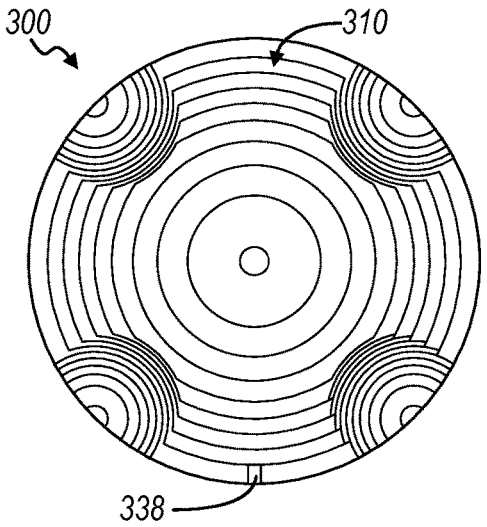
FIG. 6A is a top view of the cap.
Figure 6B:
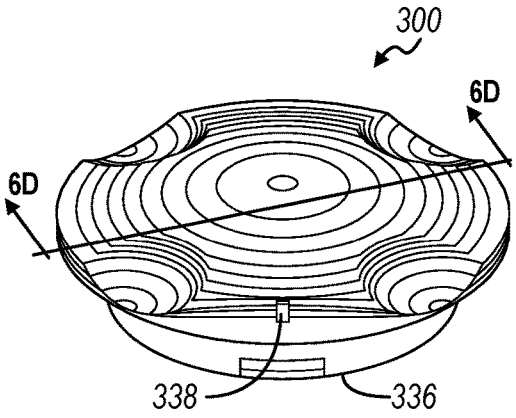
FIG. 6B is a top perspective view of the cap.

Referring to FIG. 6A, the cap 300 contains a fifth upper surface 310 and a fifth under surface 312. Referring to FIG. 6B, the fifth upper surface 310 contains at least one manner of manipulation. The at least one manner of manipulation is the assembly's feature or features which allow its user to change the orientation of the cap 300 relative to the base 200. In the embodiment depicted in the figures, the fifth upper surface 310 contains contours as a manner of manipulation. The contours are in the form of gradations. The gradations are stacked layers which follow an approximate concentric pattern. The layers form peaks and valleys relative to the cap's 300 horizontal axis. The differences between the peaks and valleys create the impression of indentations into which the assembly's user could potentially depress at least one finger to aid in the manipulation of the cap's 300 spatial orientation relative to the base 200. Further in the embodiment depicted in the figures, the fifth upper surface 310 contains four such indentations where the indentations have a semi-circular shape. Further in the embodiment depicted in the figures, the fifth upper surface 310 contains a fourth edge 326 as another manner of manipulation. In the embodiment depicted, the fourth edge 326 contains a tab. The tab is a sequential stack of gradations that has an extent, relative to the cap's 300 horizontal axis, sufficient to allow the assembly's user to apply force, pressure, or leverage to aid in the manipulation of the cap's 300 spatial orientation relative to the base 200. Further referring to FIG. 6B, a fifth upper surface 310 contains at least one manner for confirmation of alignment. A fifth upper surface 310 contains as a manner of confirmation of alignment a second set of visual indicia 328. The visual indicia provide the assembly's user a manner in which to confirm that the assembly is in a semi-secured or secured configuration. The visual indicia may take the form, for example, of words, arrows, lines, or other similar markings to allow the user to confirm whether the orientation of the cap 300 is in proper alignment with the base 200. In the embodiment shown, the second set of visual indicia 328 take the form of least one line.

Figure 6C:
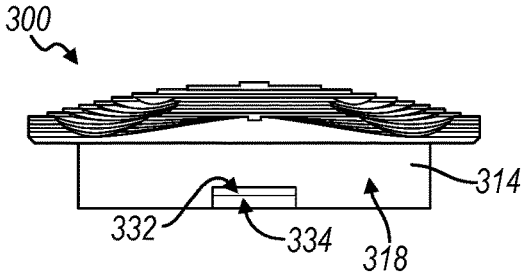
FIG. 6C is a side profile view of the cap.
Figure 6D:
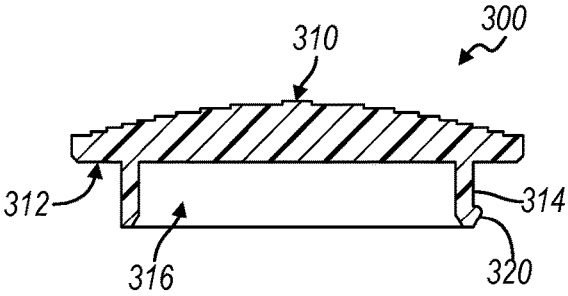
FIG. 6D is a cross-sectional view of the cap.
Figure 6E:
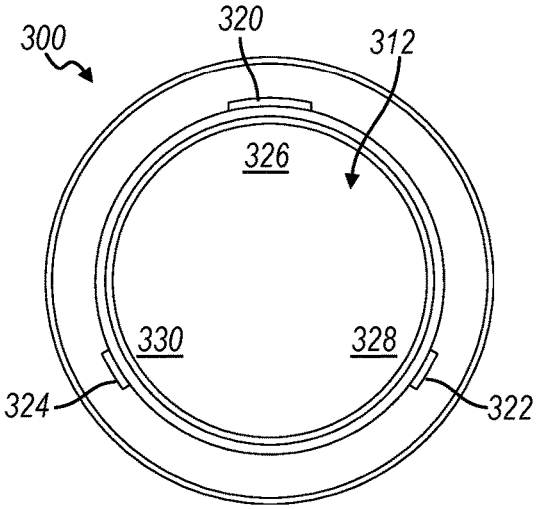
FIG. 6E is a bottom view of the cap.
Figure 6F:
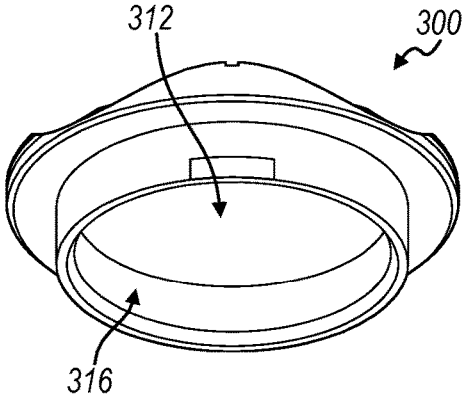
FIG. 6F is a bottom perspective view of the cap.

Referring to FIG. 6C, the cap 300 contains a third wall 314. The third wall 314 contains a third inner surface 316 and a third outer surface 318. Referring to FIG. 6D, FIG. 6E, and FIG. 6F, the third outer surface 318 contains at least one prong. The at least one prong is the means by which the assembly can be brought into a semi-secured or secured configuration via interaction between the at least one prong, the at least one ledge, and the lip 236, respectively. The at least one prong is of an extent sufficient to accommodate movement through the at least one notch and over the at least one edge. In the embodiment depicted in the figures, the cap contains three prongs where a first prong 320 is of a tenth extent 326, a second prong 322 is of an eleventh extent 328, and a third prong 324 is of a twelfth extent 330, where the tenth extent 326, the eleventh extent 328, and the twelfth extent 330 are within manufacturing tolerances of the second extent 250, the third extent 252, and the fourth extent 254, respectively. Additionally, in the embodiment depicted, the at least one prong has a sixth upper surface 332 and sixth under surface 334, where the sixth upper surface 332 is parallel to the fifth under surface 312 and the sixth under surface 334 makes an acute angle with respect to the third wall 314 and also creates a vertex with the sixth upper surface 332. The interaction between the at least one prong and the at least one ledge provides the assembly the manner by which it may be brought into a semi-secured configuration. The assembly's user must ensure proper alignment of the at least one prong with the at least one notch via the first set of visual indicia 222 and the second set of visual indicia 328. Upon confirmation of alignment of the cap 300 and the base 200, the assembly's user may exert sufficient force or leverage to press the at least one prong into the at least one notch such that the at least one prong creates an abutment with the at least one ledge. Upon application of a sufficient force, the at least one prong is urged over the vertex of the sixth upper surface 332 and the sixth under surface 334, after which the at least one prong creates and abutment with the sixth under surface 334. Upon manipulation of the cap 300 such that the at least one prong and the at least one notch are out of alignment with respect to the first set of visual indicia 222 and the second set of visual indicia 328, the at least one prong will then be in contact with the second under surface 236 of the lip, thusly securing the assembly and preventing the assembly's user from accessing the contents of the container 100.

Figure 4A:
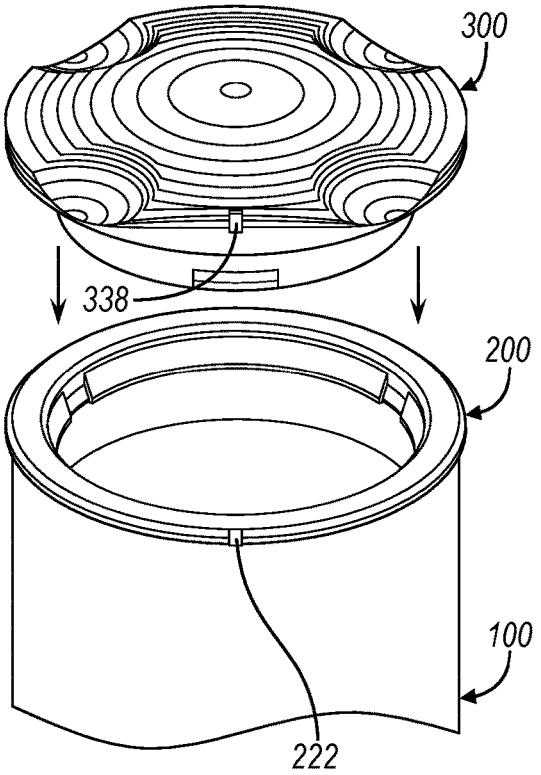
FIG. 4A is a first state of assembly of the cannabis storage assembly of FIG. 1.
Figure 4B:
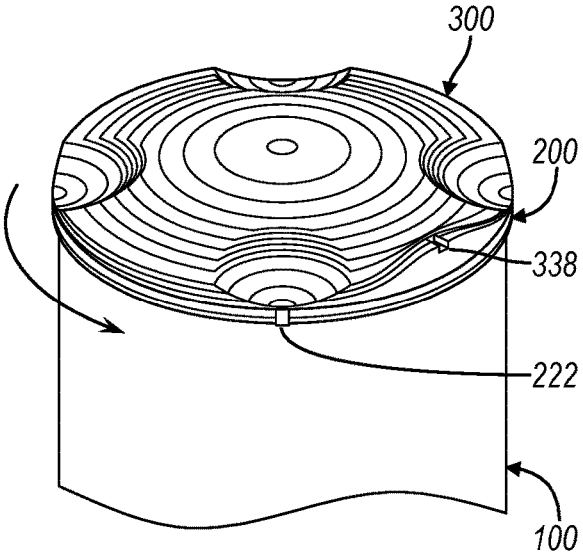
FIG. 4B is a second state of assembly of the cannabis storage assembly of FIG. 1.

Referring to FIG. 4A, an unsecured configuration is shown. In an unsecured configuration, the base 200 is inserted into the container 100. In the embodiment depicted, the at least one rib provides the manner by which the base 200 is nested into the container 100, in which the base's 200 movement is fully restricted. Further in the unsecured configuration, the cap 300 is fully removed from the base 200. As such, the assembly's user has total access to the contents contained within the container, or conversely, has the ability to place contents into the container.

Referring to FIG. 4B, a semi-secured configuration is shown. In a semi-secured configuration, the base 200 is inserted into the container 100. The at least one rib provides the means by which the base 200 is nested into the container 100, fully restricting the movement of the base 200. Further in a semi-secured configuration, the cap 300 is inserted into the base 200. The at least one prong and the at least one notch must be in proper alignment with respect to the first set of visual indicia 222 and the second set of visual indicia 328. Once the assembly's user has confirmed proper alignment, the user must use sufficient force, pressure, or leverage to overcome the resistance provided by the interaction of the at least one prong and the at least one ledge. Once the assembly's user has depressed the cap 300 fully into the base 200, the assembly will provide auditory indicia of a semi-secured configuration by via an audible click, snap, or other similar noise made by the interaction of the at least one prong and the at least one ledge. Thus, a semi-secured configuration of the assembly is one such that the cap 300 is completely inserted into the base 200, the first set of visual indicia 222 and the second set of visual indicia 328 are aligned, yet the assembly's interior volume 120 is restricted despite the fact that the cap 300 and the base 200 are in proper alignment. The assembly's user could in fact turn the assembly upside down and any contents in the container would remain securely within it. Further, in order for the assembly's user to gain access to the interior volume 120, the assembly's user would have to exert sufficient force, pressure, or leverage in the reverse direction as previously stated, such that the user could overcome the resistance provided by the interaction of the at least one prong and the at least one ledge.

Referring to FIG. 4B, a secured configuration is shown. A secured configuration incorporates all of the features and characteristics of a semi-secured configuration with the addition of further manipulation of the cap's 300 rotational orientation with respect to the base 200. In this configuration, the assembly's user may rotate the cap 300 so that the at least one prong is situated such that it is in at least partial contact with lip 236, or, alternatively, in an embodiment with two or more prongs, such as the one depicted in the figures, where a first prong 320 is in alignment with the second ledge 258 or the third ledge 260, and the second prong 322 is in alignment with the first ledge 256, where the tenth extent 326 of the first prong 320 is greater than the fifth extent 262 or the sixth extent 264 of the second ledge 258 or the third ledge 260, respectively. Thus, in a secured configuration, the assembly's user will not be able to exert any amount of force, pressure, or leverage, exclusive of the amount to destroy the assembly's structural integrity, sufficient to overcome the resistance created between the interaction of the least one prong and the lip 236, or alternatively, the misalignment of prongs and ledges.

In an alternate embodiment, the assembly contains all of the features disclosed in the previous embodiment, where the points of difference are that the base 200 contains an outer surface which contains at least one prong, and the cap 300 contains the lip 236, where the lip 236 contains at least one notch and the at least one notch in turn contains at least one ledge. Just as in the previously disclosed embodiment, beginning in an unsecured configuration, the assembly's user must manipulate the cap's 300 rotational orientation relative to the base 200 such that the at least one prong and the at least one notch are in alignment. Once in alignment, the user may press the cap 300 down into the base 200, urging the at least one prong over the at least one ledge, thus bringing the assembly into a semi-secured configuration. After which, the assembly's user may manipulate the cap's 300 rotational orientation such that the at least one prong and the at least one notch are out of alignment, and the at least one prong is in at least partial contact with the lip 236, thus bringing the assembly into a secured configuration.

In yet another alternate embodiment, the assembly contains all of the features disclosed with respect to the embodiment depicted in the figures, where the point of difference is that the assembly contains a cap 300, a base 200, and a container 100, in which the base 200 and container 100 are a unitary feature. That is, the base 200 and the container 100 are a single component of the cannabis storage assembly 10 within this embodiment.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

What is claimed is:

1. A cannabis storage assembly, comprising:

a container having a wall; and a cap assembly situated on an open end of the container, the cap assembly includes a base and a cap;

the base has a lip, the lip defines at least one notch, the at least one notch having a ledge spanning at least partially across the at least one notch; and the cap having at least one prong;

wherein, the cannabis cap assembly possesses a corresponding number of prongs to notches;

wherein, in order to bring the cap assembly to a fully secured state, the at least one prong of the cap is brought into alignment with the at least one notch of the lip, and the at least one prong is urged over the ledge of the lip.

2. A cannabis storage assembly, comprising:

a container having a wall; and a cap assembly situated on an open end of the container, the cap assembly includes a base and a cap;

the base has a lip, the lip defines a first notch of a first extent and a second notch of a second extent, the first extent being different than the second extent; and the cap having a first prong of a third extent and a second prong of a fourth extent, the third extent being different than the fourth extent;

wherein, in order to bring the assembly to a fully secured state, the first prong of the cap is brought into alignment with the first notch of the lip and the second prong of the cap is brought into alignment with the second notch of the lip, and wherein the cap assembly is prevented from being brought to the fully secured state when the first prong of the cap is misaligned with the first notch of the lip and the second prong of the cap is misaligned with the second notch of the lip.

3. A cannabis storage assembly, comprising:

a container having a wall; and a cap assembly situated on an open end of the container, the cap assembly includes a base and a cap;

the cap has a lip, the lip defines a first notch of a first extent and a second notch of a second extent, the first extent being different than the second extent; and the base having a first prong of a third extent and a second prong of a fourth extent, the third extent being different than the fourth extent;

wherein, in order to bring the assembly to a fully secured state, the first prong of the base is brought into alignment with the first notch of the lip and the second prong of the base is brought into alignment with the second notch of the lip, and wherein the cap assembly is prevented from being brought to the fully secured state when the first prong of the base is misaligned with the first notch of the lip and the second prong of the base is misaligned with the second notch of the lip.

4. The cannabis storage assembly of claim 1, wherein the cap contains at least one surface sufficient to allow the user of the cannabis cap assembly to manipulate the spatial orientation of the cap by rotating it relative to the base.

5. The cannabis storage assembly of claim 1, wherein the lip has a radially-inwardly directed expanse sufficient such that the at least one prong is prevented from being urged over the lip.

6. The cannabis storage assembly of claim 1, wherein the at least one ledge has a radially-inwardly directed expanse sufficient such that the user of the cannabis cap assembly is able to urge the at least one prong over the at least one ledge.

7. The cannabis storage assembly of claim 1, wherein the lip has a first radially-inwardly directed expanse and the at least one ledge has a second radially-inwardly directed expanse, the first radially-inwardly directed expanse being greater than the second radially-inwardly directed expanse.

8. The cannabis storage assembly of claim 1, wherein the base contains at least one manner of immobilization which facilitates a press-fit restriction on the base such that the cannabis cap assembly's movement is prevented upon mounting of the container.

9. The cannabis storage assembly of claim 1, wherein the cap contains a first set of visual indicia such that the user of the cannabis cap assembly can confirm spatial alignment of the cap relative to the base.

10. The cannabis storage assembly of claim 9, wherein the base contains a second set of visual indicia such that the user of the cannabis cap assembly can confirm spatial alignment of the base relative to the cap.

11. The cannabis storage assembly of claim 1, wherein the cannabis cap assembly possesses a single lip at the base.

12. The cannabis storage assembly of claim 1, wherein the cannabis cap assembly possesses a corresponding number of notches to prongs and no additional notches.

13. The cannabis storage assembly of claim 1, wherein the cannabis cap assembly possesses a corresponding number of ledges to notches.

14. The cannabis storage assembly of claim 10, wherein the user of the cannabis cap assembly, in order to fully secure the cannabis cap assembly, first aligns the cap and the base relative to the first set of visual indicia and the second set of visual indicia.

15. The cannabis storage assembly of claim 13, wherein the user of the cannabis cap assembly, in order to fully secure the cannabis cap assembly, must press the cap into the base once aligned such that the at least one prong is urged over the at least one ledge.

16. The cannabis storage assembly of claim 14, wherein the user of the cannabis cap assembly, in order to fully secure the cannabis cap assembly, must rotate the cap relative to base after the at least one prong has been urged over the at least one ledge such that the at least one prong is at least partially misaligned with the at least one notch.

17. The cannabis storage assembly of claim 1, wherein the surface of the at least one prong has the requisite angle such that the at least one prong can interact with the at least one ledge in a manner such that the user of the cannabis cap assembly can bring the cannabis cap assembly to a fully secured state.

18. The cannabis storage assembly of claim 1, wherein the surface of the at least one ledge has the requisite angle such that the at least one ledge can interact with the at least one prong in a manner such that the user of the cannabis cap assembly can bring the cannabis cap assembly to a fully secured state.

19. The cannabis storage assembly of claim 1, wherein the extent of the at least one prong is within manufacturing tolerances of the extent of the at least one notch such that the first notch may only pass through the first notch and no other notches.

* * * * *